US005325047A

United States Patent [19]

Kempton

[11] Patent Number: 5,325,047

[45] Date of Patent: Jun. 28, 1994

[54] VOLTAGE MONITORING APPARATUS, AS FOR MONITORING CATHODIC PROTECTION VOLTAGE ON AN UNDERGROUND PIPELINE

[75] Inventor: Marvin Kempton, Schererville, Ind.

[73] Assignee: After Zero Technology Corporation, Schererville, Ind.

[21] Appl. No.: 931,022

[22] Filed: Aug. 17, 1992

[51] Int. Cl.[5] ..... G01R 31/02; G01R 19/00; H01H 35/00

[52] U.S. Cl. ..... 324/72; 324/102; 307/131

[58] Field of Search ..... 324/73.1, 72, 71.1, 324/452, 439, 102, 119; 307/131, 125

[56] References Cited

U.S. PATENT DOCUMENTS

| | | | |
|---|---|---|---|
| 2,249,323 | 7/1941 | Mitchell | 324/102 |
| 2,591,738 | 4/1952 | Spencer | 324/102 |
| 2,784,322 | 3/1957 | Johnson | 307/131 |
| 3,465,208 | 9/1969 | Patrickson et al. | 307/131 |
| 3,633,071 | 1/1972 | Fendt | 307/131 |
| 4,029,937 | 6/1977 | Russell | 307/131 |
| 4,080,565 | 3/1978 | Polak et al. | 324/71.1 |
| 4,219,807 | 8/1980 | Speck et al. | 324/72 |
| 4,255,669 | 3/1981 | Naugle | 307/131 |
| 4,437,065 | 3/1984 | Woudstra | 324/71.1 |
| 4,591,792 | 5/1986 | Birchmeier et al. | 324/425 |
| 4,642,481 | 2/1987 | Bielinski et al. | 307/131 |
| 4,816,747 | 3/1989 | Bushman et al. | 324/71.1 |
| 4,903,130 | 2/1990 | Kitagawa et al. | 307/131 |

*Primary Examiner*—Maura K. Regan
*Attorney, Agent, or Firm*—Wallenstein, Wagner & Hattis, Ltd.

[57] ABSTRACT

A voltage monitoring apparatus for monitoring a value of a rectified AC voltage applied across a capacitive load is disclosed. The voltage has an AC component and a DC component. The apparatus monitors the value of the rectified cyclical AC voltage at a selected portion of the cycle. The voltage to be measured can either be the instantaneous value of the voltage at a predetermined time in the cycle, or the RMS value of the entire cycle. The apparatus is especially useful for monitoring a cathodic protection voltage applied to a metallic structure in contact with the ground and subject to corrosion, such as often applied to an underground pipeline. Such voltage is typically full wave rectified AC, and it is beneficial to know if the minimum voltage value of each cycle applied to the pipeline is below a predetermined value.

6 Claims, 2 Drawing Sheets

VOLTAGE MONITORING APPARATUS, AS FOR MONITORING CATHODIC PROTECTION VOLTAGE ON AN UNDERGROUND PIPELINE

DESCRIPTION

1. Technical Field

The application relates to an apparatus for monitoring a voltage, and more particularly, to an apparatus for monitoring a cathodic protection voltage applied to metal structures in contact with the earth, such as an underground pipeline.

2. Background Prior Art

It is well known to apply a dc voltage, often referred to as a cathodic protection voltage, between a buried pipeline and buried anodes to prevent destructive corrosion of the pipeline. It is believed that the cathodic protection voltage could also be advantageously utilized to protect other metal structures in contact with the earth.

Typically this dc voltage is a full-wave rectified voltage, which cyclicly varies from a peak value to a minimum value. The minimum value of the dc voltage will vary as a function of the capacitance of the ground in which the pipeline is buried. It is important to monitor this minimum voltage, to insure that the minimum voltage does not fall below a predetermined value.

In addition, it is known that the buried anodes will progressively deteriorate, reducing their respective current carrying capability. Thus it is important to monitor the RMS value of the current passing through the various anodes.

Finally, the cathodic protection voltage is often provided at remote sites. It is important to be able to continuously monitor and electronically store the values of the voltages and currents, and to periodically transmit this data to a central monitoring station.

The present invention is provided to solve these and other problems.

SUMMARY OF THE INVENTION

It is an object of the invention to provide a voltage monitoring apparatus, such as for monitoring a value of a rectified AC voltage applied across a capacitive load.

In accordance with the invention, the voltage has an AC component and a DC component. The apparatus monitors the value of the rectified cyclical AC voltage at a selected portion of the cycle. The voltage to be measured can either be the instantaneous value of the voltage at a predetermined time in the cycle, or the RMS value of the entire cycle.

The apparatus is especially useful for monitoring the cathodic protection voltage often applied to an underground pipeline. Such voltage is typically full wave rectified AC, and it is beneficial to know if the minimum voltage value of each cycle applied to the pipeline is below a predetermined value. It is also beneficial to monitor the condition of the anodes supplying the cathodic protection voltage to the pipeline.

The apparatus could also be utilized to monitor cathodic protection voltage applied to other metallic structures in contact with the earth, such as service station storage tanks, sanitary lift stations, oil wells and gas production facilities, concrete reinforcements hydroelectric generation facilities, lead sheath cable, missile silos, melting devices for aircraft runways, docks and pilings, and the like.

Other features and advantages of the invention will be apparent from the following specification taken in conjunction with the following drawing.

DETAILED DESCRIPTION

Figure 1:
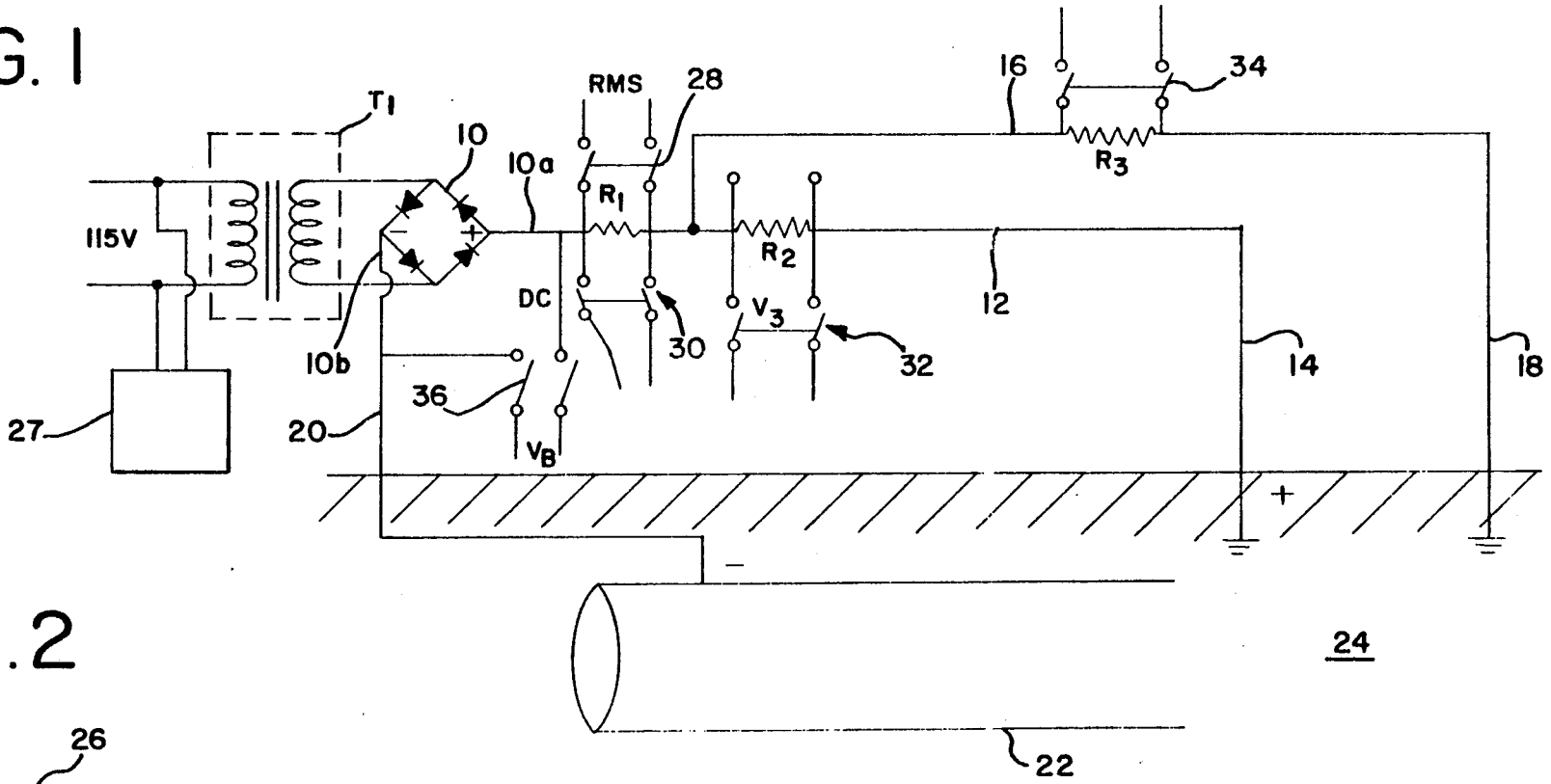
FIG. 1 is a generalized block diagram of a system in accordance with the present invention for providing cathodic protection voltage to a buried pipeline.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

Referring to FIG. 1, 115 volts ac, as provided by a conventional utility line, is provided to a conventional transformer T1. The transformer T1 reduces the voltage to a voltage which is typically in the range of 23 to 50 volts ac.

This reduced voltage is rectified by a conventional full wave rectifier bridge 10. The rectifier bridge 10 has a positive output 10*a* which is coupled by a first conductor 12 to a first buried anode 14, and by a second conductor 16 to a second buried anode 18. The rectifier bridge 10 further includes a negative output 10*b* which is coupled by a third conductor 20 to a pipeline 22 buried in the ground 24. It is contemplated that the rectifier bridge 10 could also be coupled across the ground and such other metallic structures which are in contact with the ground and subject to corrosion.

Figure 2:
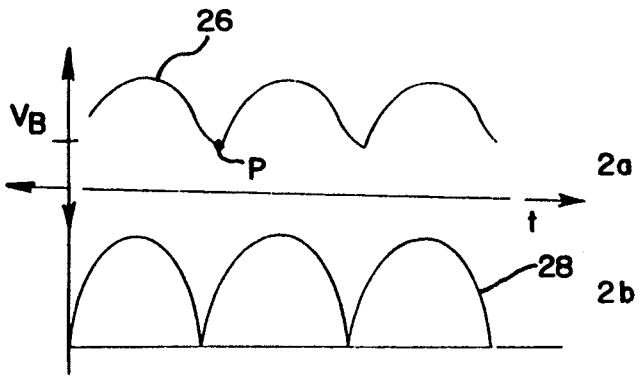
FIG. 2 illustrate various waveforms in the system.

The rectifier bridge 10 provides a voltage between the pipeline and ground which measures approximately −0.85 volts along the pipeline, as measured by a copper/copper sulfate half-cell. This voltage, selected by a corrosion engineer, is determined by the output voltage of the transformer T1. This dc voltage, commonly referred to as a cathodic protection voltage, causes a hydrogen ion build-up around the pipeline 22, to prevent detrimental corrosion. Because the ground 24 is, at least in part, capacitive, the voltage applied to the pipeline 22 is not a perfect full-wave rectified sinusoid, but rather is generally as illustrated as waveform 26 in FIG. 2.

It is important, for optimal protection of the pipeline 22, that the lowest voltage level applied to the pipeline 22, as shown at point P of the waveform 26, does not fall below a predetermined value, as set by the corrosion engineer. It is also important that the RMS value of the voltage applied to the pipeline 22 is regulated as close as possible to a value set by the corrosion engineer, which is of the order of −0.85. Additionally, the anodes 14,18 will slowly deteriorate. It is important to monitor the current through the anodes 14,18, to determine when replacement thereof is required.

In accordance with the invention, a control 27 is provided for monitoring the value of the lowest voltage level applied to the pipeline 22, as well as to monitor the RMS value of the waveform 26. The control 27 further monitors the RMS current through the anodes 14,18.

First, second and third shunt resistors R1, R2, R3, respectively, are disposed in the first and second conductors 12,16. As mentioned above, the first anode 14 and the second anode 18 will progressively deteriorate over time. The shunt resistors R1, R2, R3 are provided to develop a measurable voltage, which can be used to indicate the RMS current through each of the first and second anodes 14,18, as well as the RMS current provided by the rectifier 10, which provides an indication of the condition of the first and second anodes 14,18.

First and second relays 28,30, respectively, are coupled across the first shunt resistor R1. A third relay 32 is coupled across the second shunt resistor R2, and a fourth relay 34 is coupled across the third shunt resistor R3. A fifth relay 36 is coupled across the positive and negative outputs 10*a*, 10*b*, of the rectifier bridge 10. Each of the relays 28,30,32,34,36 is coupled to the control 27. By selectively closing and opening each of the relays 28,30,32,34,36, the respective voltages across the relays can be measured. As discussed below, the control 27 includes circuitry to measure the lowest dc voltage level across the outputs of the rectifier 10, as well as the lowest dc voltage level across the first shunt resistor R1. Additionally, the control 27 includes circuitry to measure the RMS value of the voltage, which is indicative of the RMS value of the current, across the first, second and third shunt resistors R1, R2, R3.

Figure 3:
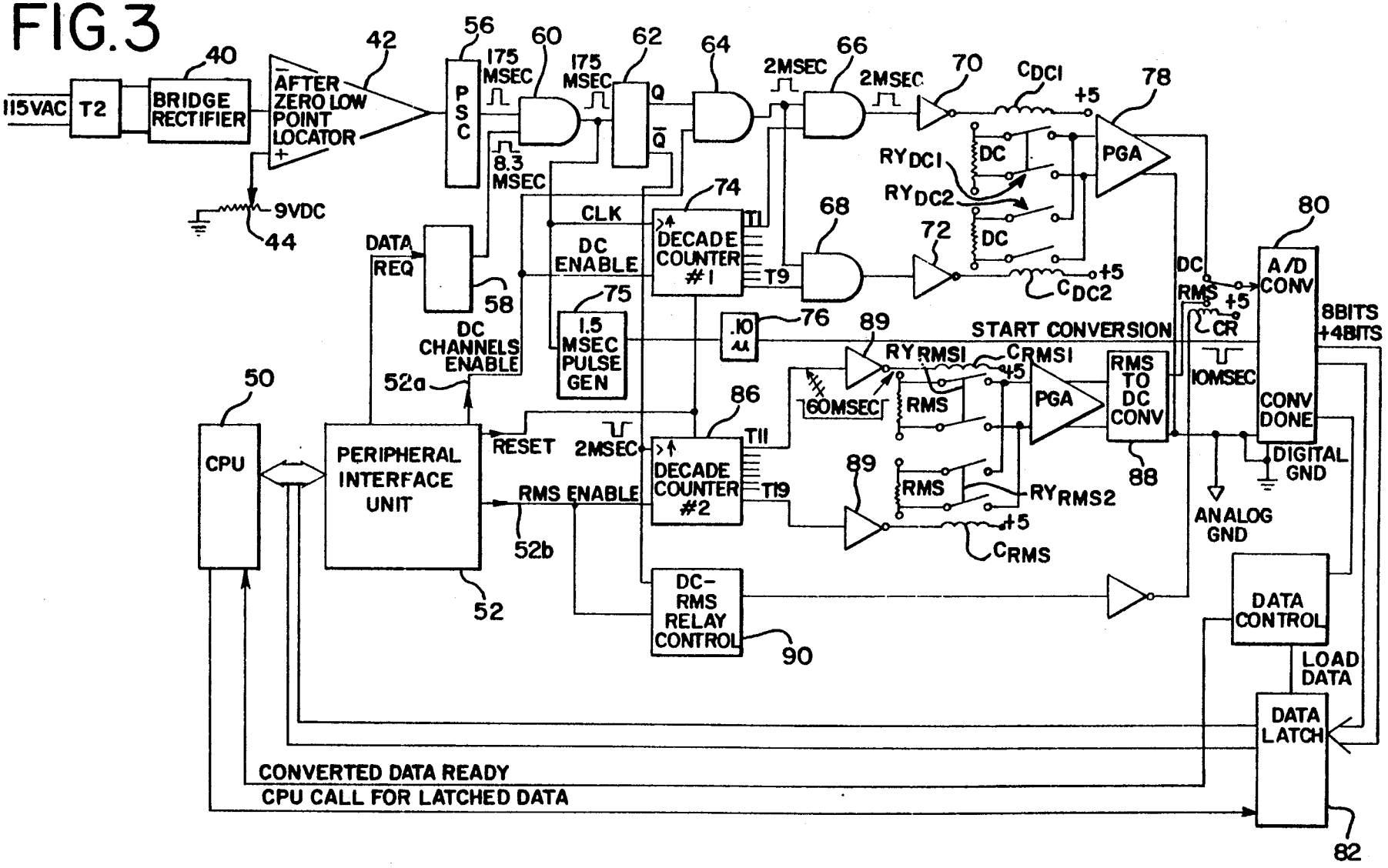
FIG. 3 is a block diagram of a system for measuring voltages and currents as supplied by the system of FIG. 1.

The control 27 for performing the above detection is generally disclosed in FIG. 3. One hundred fifteen volts ac is provided by the same source as providing the power to the pipeline 22, discussed above. The 115 v ac power is reduced by a second transformer T2, which output voltage is rectified by a second rectifier bridge 40. The second rectifier bridge 40 outputs an approximately 10 volt peak-to-peak, 120 Hz full wave rectified dc voltage. The output of the second rectifier bridge 40 is shown as a second waveform 28 in FIG. 2*b*. The control 27 utilizes the second waveform 28 as a timing signal to trigger the ultimate closing and opening of the relays 28,30,32,34,36 of FIG. 1. For purposes of clarity, the relays have been designated $RY_{DC1}$, $RY_{DC2}$, $RY_{RMS1}$, $RY_{RMS2}$ in FIG. 3.

The full-wave rectified output of the second rectifier 40 is coupled to the inverting input of a comparator, herein referred to as a low-point detector, or LPD 42. The non-inverting input of the LPD 42 is coupled to a potentiometer 44, which is coupled to a conventionally provided 9 volt-dc reference source. The LPD 42 uses the output of the second rectifier 40 (waveform 28) as a timing reference to generate a control signal to cause the closure of the relays at the proper time. The period of the 120 Hz reference signal is 8.33 msec, and the low point of the dc voltage to be measured will occur at the same point during each cycle of the waveform 28.

With reference to FIG. 3, the term "dc relays" will mean relays used to measure the low point of a dc voltage, while the term "RMS relays" will mean the relays used to measure an RMS voltage.

The LPD 42 is used to cause the selective closure of the dc relays during the low-point of the particular dc voltage to be measured. Additionally, the LPD 42 is used to cause the selective closure of the RMS relays for a sufficiently long period of time to determine the particular RMS voltage.

The control 27 includes a conventional central processing unit, or CPU, 50, coupled to a conventional peripheral interface unit, or PIU, 52. The CPU 50 sequentially issues data request commands via the PIU 52 to selectively cause the closure of the dc and RMS relays, respectively, and the reading of the respective voltages, discussed below.

Specifically, the LPD 42 generates a positive going pulse when the waveform 28 goes higher than the reference voltage, as set by the potentiometer 44. This positive going pulse generated by the LPD 42 triggers a pulse-shaping circuit, or PSC, 56 to generate a 175 μsec pulse. Thus, the PSC 56 generates a 175 μsec pulse every 8.33 msec (i.e., once per each 120 Hz cycle), and this 175 μsec pulse is time-coordinated with the low-point of the dc voltage to be measured.

The data request command from the CPU 50, via the PIU 52, causes a pulse-circuit 58 to generate an 8.33 msec duration pulse. This 8.33 msec pulse is "anded" with the 175 μsec pulse by an AND gate 60. Thus, the AND gate 60 passes the 175 μsec pulse, as controlled by the data request command from the CPU 50.

When the CPU 50, under software control, issues a data request command, the CPU 50 also simultaneously issues either a dc enable signal (via a line 52*a*) or an RMS enable signal (via a line 52*b*), depending on whether the voltage to be measured is a dc voltage or an RMS voltage. The 175 μsec pulse generated by the AND gate 60 triggers a 2 msec pulse generator 62, having both a Q and an $\overline{Q}$ output. The dc enable signal and the 2 msec Q output of the pulse generator 62 are "anded" together by an AND gate 64. Thus the output of the AND gate 64 goes high at a time coordinated with the occurrences of both a dc enable signal from the CPU 50 to read a dc voltage and the low point of the dc voltage to be measured. The 2 msec output of the AND gate 64 is coupled both to an AND gate 66 and an AND gate 68. The AND gate 66 is coupled via an inverter 70 to a coil $C_{DC1}$ of first dc relay $RY_{DC1}$. The AND gate 68 is coupled via an inverter 72 to a coil $C_{DC2}$ of the second dc relay $RY_{DC2}$. These dc relays correspond to the ones of the relays of FIG. 1 for measuring the respective low points of selected dc voltages.

The other inputs to the AND gates 66 and 68 are coupled to respective outputs of a first decade counter 74. The first decade counter 74 sequentially steps through its outputs $t_0$–$t_9$, sequentially enabling the AND gates coupled thereto, such as AND gates 66 and 68. For the purposes of this disclosure, only the two AND gates 66,68 are shown; however, it is to be understood that more could be used if additional dc voltages are to be measured.

When output $t_1$ of the first decade counter 74 goes high, the 2 msec output of the AND gate 64 is passed through the AND gate 66, which causes the output of the inverter 70 to go low, energizing the coil $C_{DC1}$, and closing the first relay $RY_{DC1}$ for 2 msec. The output of the AND gate 60 also triggers a pulse delay generator 75, which generates a 1.5 msec pulse. The trailing edge of this 1.5 msec pulse triggers a conversion pulse generator 76, which generates a 10 μsec start conversion pulse. Thus, the first dc relay $RY_{DC1}$ is closed by the 2 msec pulse, and 1.5 msec later, the voltage across the first dc relay as amplified by an amplifier 78, is then read by a conventional A/D converter 80. Similarly, when output t9 of the counter 74 goes high, the 2 msec output of the AND gate 64 is passed through the AND gate 68, which causes the output of the inverter 72 to go low, energizing the second dc coil $C_{DC2}$, closing the relay for 2 msec. The voltage across the second dc relay, as amplified by the amplifier 78, is then read by the A/D converter 80, upon command of the start conversion pulse. The 1.5 msec delay between the relay closure and the conversion pulse permits stabilization of the relay.

The output of the A/D converter 80 is conventionally stored in a data latch 82, to be sequentially read by the CPU 50 via conventional data communication.

In summary, the voltage on the potentiometer 44 is set so that the conversion pulse, and hence the reading of the voltage across the respective dc relay, occurs precisely at the time of the low point of the dc voltage to be measured. This is accomplished by adjusting the potentiometer 44 while monitoring the dc voltage, such as by an oscilloscope.

After the CPU 50 has cycled the first decade counter 74 to enable each of the AND gates coupled thereto, the CPU 50 resets the first decade counter 74 via a reset command and then sequentially issues an RMS enable command via the line **52*b* to similarly cycle a second decade counter 86**, which causes the closure of the RMS relays $RY_{RMS1}$, $RY_{RMS2}$.

The RMS voltages are calculated by an RMS-to-dc converter 88, such as distributed by Analog Devices, of Norwood, Mass. The RMS-to-dc converter 88 requires at least 25 msec to dwell on the RMS voltage to be measured. However, this measurement does not have to be coordinated with any particular part of the waveform 28. Thus, when measuring the RMS voltages, the $\overline{Q}$ output of the pulse generator 62 is used, because the $\overline{Q}$ output remains high for 60 msec. The $\overline{Q}$ output of the pulse generator 62 cycles the outputs of the second decade counter 86, to sequentially close and open the first and second RMS relays $RY_{RMS1}$, $RY_{RMS2}$, via inverters 89 and coils $C_{RMS1}$ and $C_{RMS2}$ in a similar manner as described above. The RMS relays are closed for 60 msec, which provides adequate time for the RMS to dc converter 88 to calculate the RMS voltage. An RMS relay control 90, under command of the $\overline{Q}$ output and the RMS enable command, closes an RMS/dc coil $C_R$, to couple the A/D converter 80 to the RMS to dc converter. This data, too, is latched by a data latch 82 before being read by the CPU 50.

Thus, the control 27 first sequentially causes each of the dc relays to close at the low point of the respective dc voltages to be measured. The control 27 then sequentially causes each of the RMS relays to close, but for a longer period of time to permit calculation of the respective RMS voltages to be measured.

If located in a remote area, the CPU 50 can be coupled to a conventional modem (not shown) to permit periodic transmission of the voltage data to a central monitoring station. Additionally, the CPU 50 can transmit an error message to the central monitoring station, such as upon detection of an error, such as loss of voltage on the pipeline. Further, the CPU 50 can be periodically queried by the central monitoring station.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A system for providing a monitored cathodic protection voltage from a source of AC voltage to a capacitive load including a submerged metallic structure, said first rectified cyclical voltage having an AC component and a DC component, comprising:

a first rectifier having an input and an output, said input adapted to be coupled to said AC voltage source, and said output adapted to be coupled to said structure, said first rectifier producing said cathodic protection voltage for application to said structure;

a second rectifier having an input adapted to be coupled to said AC source, said second rectifier further having an output and producing a second, rectified cyclical voltage at said output, said second cyclical voltage having a constant phase relationship with said first cyclical voltage;

selective coupling means coupled to said output of said first rectifier, said selective coupling means responsive to a characteristic of said rectified voltage indicative of the protection being afforded the structure;

means for determining the cyclical occurrence of a selected value of said second cyclical voltage;

means responsive to said determining means for actuating said selective coupling means upon the cyclical occurrence of said selected value of said second cyclical voltage, and developing a voltage across said actuated selective coupling means, said developed voltage representing said characteristic to be measured; and means responsive to said determining means for measuring said voltage across said actuated selective coupling means.

2. The apparatus of claim 1 wherein said second rectifier has a positive output terminal and a negative output terminal and said selective coupling means is coupled across said positive output terminal and said negative output terminal.

3. The apparatus of claim 2 wherein said relay is closed coincident upon the cyclical occurrence of the minimal value of said first voltage.

4. The apparatus of claim 1 wherein said characteristic to be measured comprises the RMS value of voltage applied to said load.

5. The apparatus of claim 1 wherein said characteristic to be measured comprises the minimal value of current applied to said load.

6. The apparatus of claim 1 wherein said characteristic to be measured comprises the RMS value of current applied to said load.

* * * * *